US008066049B1

(12) United States Patent
Liu et al.

(10) Patent No.: US 8,066,049 B1
(45) Date of Patent: Nov. 29, 2011

(54) AUTOMATIC GLUING MECHANISM

(75) Inventors: Jung-kuang Liu, Tu Cheng (TW); Tsai-sheng Shen, Tu Cheng (TW); Han-wei Wang, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 0 days.

(21) Appl. No.: 12/841,905

(22) Filed: Jul. 22, 2010

(51) Int. Cl.
*B05D 5/00* (2006.01)

(52) U.S. Cl. ..... 156/578; 118/300; 118/313; 118/115; 118/323; 118/321

(58) Field of Classification Search ..... 156/578
See application file for complete search history.

(56) References Cited

U.S. PATENT DOCUMENTS 6,068,202 A * 5/2000 Hynes et al. ..... 239/290

* cited by examiner

*Primary Examiner* — Philip Tucker
*Assistant Examiner* — Vicki Wu

(74) *Attorney, Agent, or Firm* — Cheng-Ju Chiang

(57) ABSTRACT

An automatic gluing mechanism includes a vertical board and a support rack and a power cylinder mounted to the vertical board. The mechanism includes a position adjusting member, a cam, two glue applicator tubes, a first connection block, two slidable members, a resilient element, and a stop block. The position adjusting member is slidably coupled to the vertical board and has an end coupled to the power cylinder and another end slidably coupled to the first connection block. The two slidable members are slidably mounted to the first connection block. The two glue applicator tubes are rotatably mounted to the two slidable members and connected to each other by the resilient element. The cam is mounted to the position adjusting member and forms a camming surface. The slidable members engage and follow the camming surface. The stop block is mounted to the support rack to stop the first connection block.

7 Claims, 3 Drawing Sheets

AUTOMATIC GLUING MECHANISM

BACKGROUND OF THE INVENTION

1. Field of the Invention

The present invention generally relates to a mechanism for applying glue or adhesives, and in particular to an automatic gluing mechanism.

2. The Related Arts

A conventional glue application mechanism comprises a power device that drives the glue application mechanism to move in a vertical direction, a mounting member that is coupled to the power device, a rail that is perpendicularly mounted to the mounting member, two slide blocks slidably attached to the rail, a driving device that drives the slide blocks to slide along the rail, and two glue application tubes that are respectively mounted to the two slide blocks.

The conventional glue application mechanism is operated as follows. The power device first drives the glue application mechanism to move in the vertical direction. When the glue application mechanism reaches a predetermined vertical location where a work piece to which glue is to be applied is located, the power device stops driving the vertical movement of the glue application mechanism. Afterwards, the driving device drives the two slide blocks to slide along the rail so that the two glue application tubes are caused to move in a horizontal direction. When the two glue application tubes are moved to such locations where the glue application tubes engage opposite sides of the work piece, the two glue application tubes dispense glue to the work piece to complete a cycle of glue application.

Disadvantages are found in the conventional glue application mechanism. For example, the vertical movement of the glue application tubes is controlled by the power device, while the horizontal movement is controlled by a separate driving device. This complicates the structure of the conventional glue application mechanism, making the manufacturing cost high. In addition, the glue application operation performed by the conventional glue application mechanism is also disadvantages in respect of complication control and excessive consumption of time. This certainly deteriorates operation efficiency of the glue application mechanism.

SUMMARY OF THE INVENTION

An objective of the present invention is to overcome the problem discussed above by providing an automatic gluing mechanism, which is constructed to reduce the cost for manufacturing the gluing mechanism and also helps shortening the cycle time of glue application, which improves operation efficiency of the gluing mechanism.

To achieve the above objective, the present invention provides an automatic gluing mechanism, which comprises a vertical board, a support rack perpendicularly mounted to an end of the vertical board, and a power cylinder mounted to an opposite end of the vertical board. The automatic gluing mechanism further comprises a position adjusting member, a cam, two glue applicator tubes, a first connection block, two slidable members, a resilient element, and a stop block. The position adjusting member is slidably coupled to the vertical board and has an end coupled to the power cylinder and another end slidably coupled to the first connection block. The two slidable members are slidably mounted to the first connection block. The two glue applicator tubes are respectively and rotatably mounted to the two slidable members and are resiliently connected to each other by the resilient element. The cam has an end mounted to the position adjusting member and an opposite end forming a camming surface. The slidable members engage and thus follow the camming surface of the cam. The stop block is mounted to the support rack to stop excessive downward movement of the first connection block.

As described above, the present invention provides an automatic gluing mechanism, which uses only the vertical movement induced by the power cylinder to control both the vertical movement of the glue applicator tubes in a vertical direction that is for adjustment of the vertical position of the glue applicator tubes and the horizontal movement of the glue applicator tubes in a horizontal direction that is for adjustment of horizontal spacing distance between the two glue applicator tubes. This improves the operation efficiency of the automatic gluing mechanism. Further, since the automatic gluing mechanism has a simple construction so that the manufacturing cost of the automatic gluing mechanism can be reduced.

BRIEF DESCRIPTION OF THE DRAWINGS

The present invention will be apparent to those skilled in the art by reading the following description of a preferred embodiment of the present invention, with reference to the attached drawings, in which.

DETAILED DESCRIPTION OF PREFERRED EMBODIMENT

Figure 1:
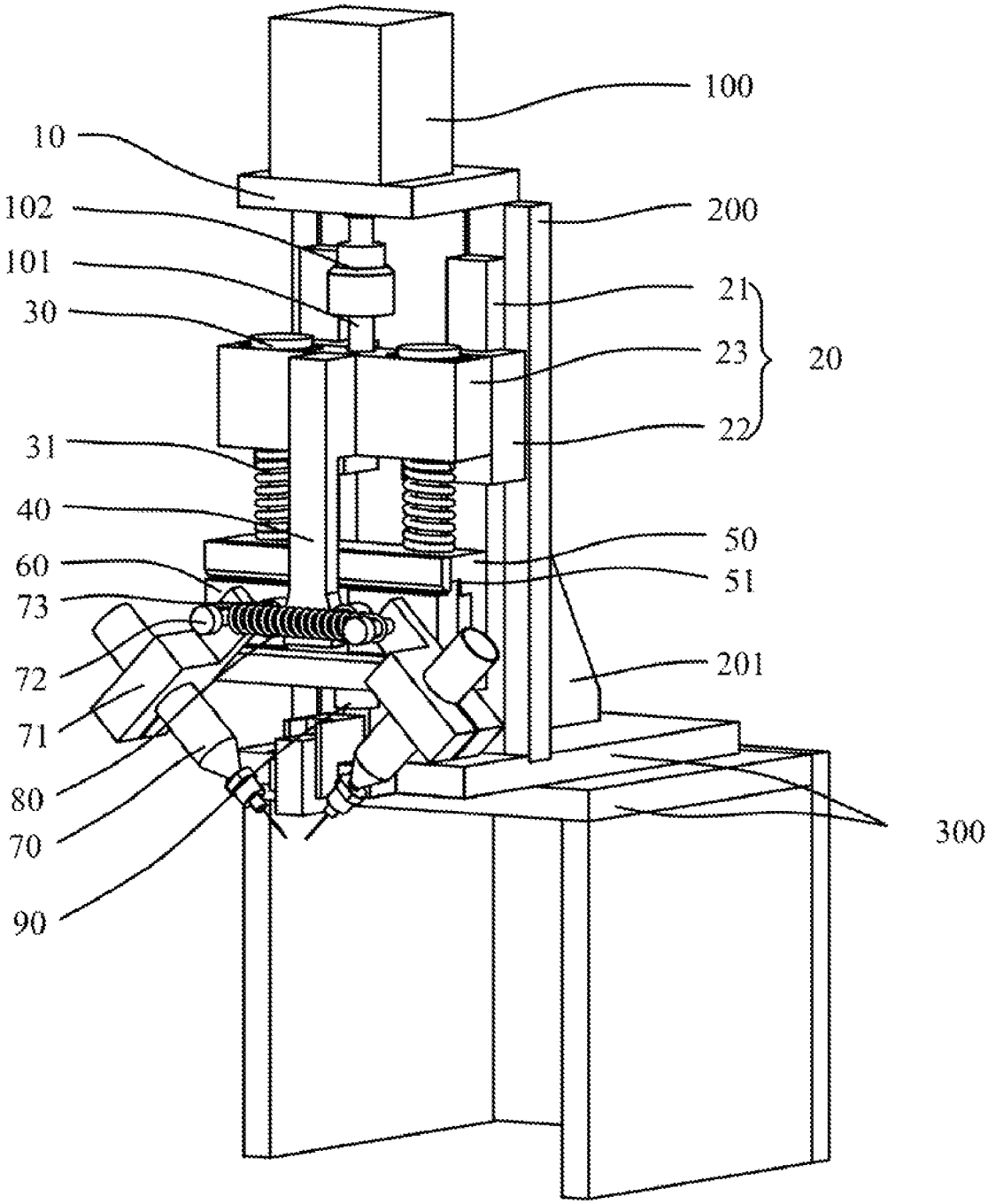
FIG. 1 is a perspective view showing an automatic gluing mechanism according to the present invention.
Figure 2:
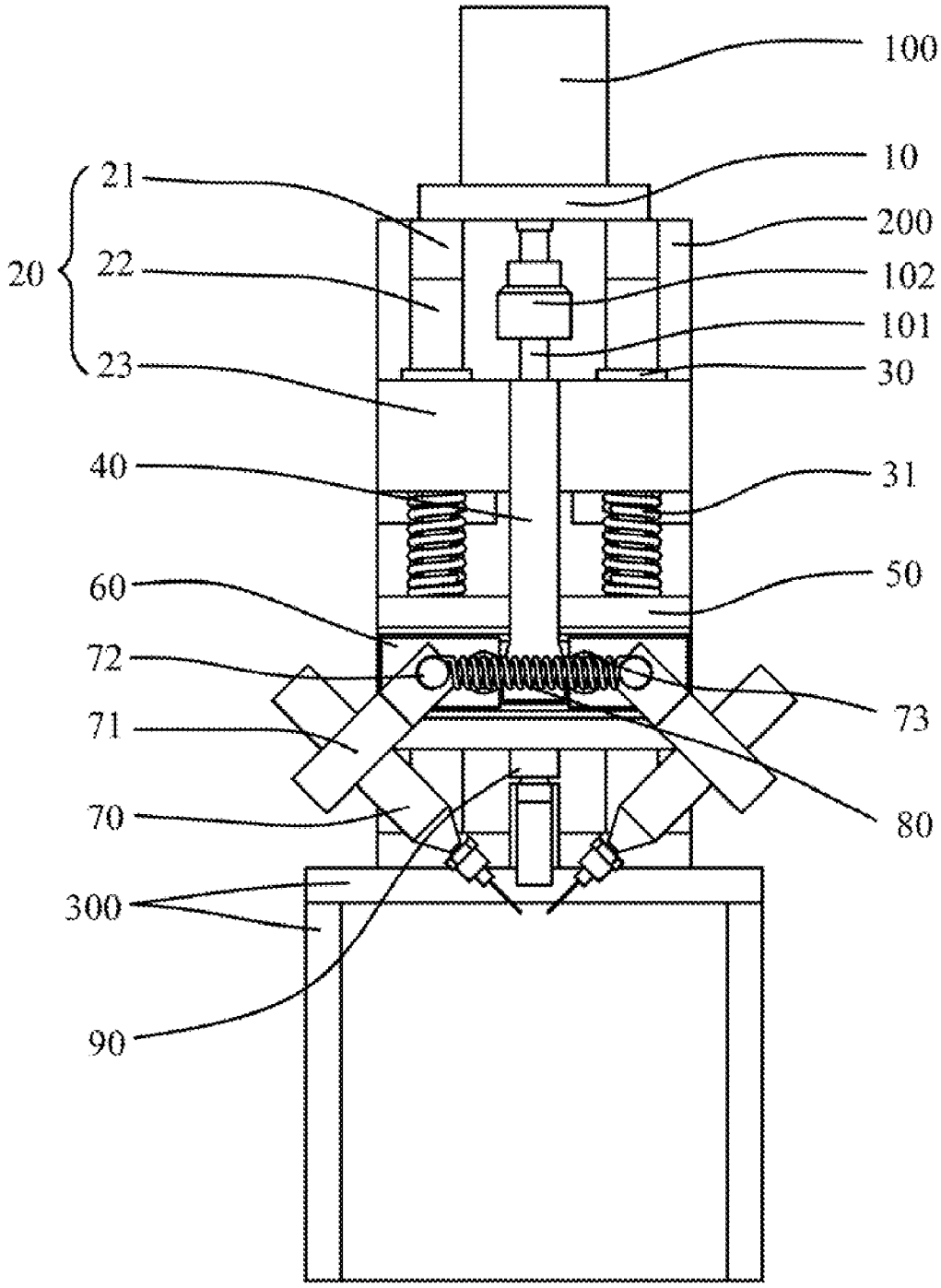
FIG. 2 is a front view of the automatic gluing mechanism shown in FIG. 1.
Figure 3:
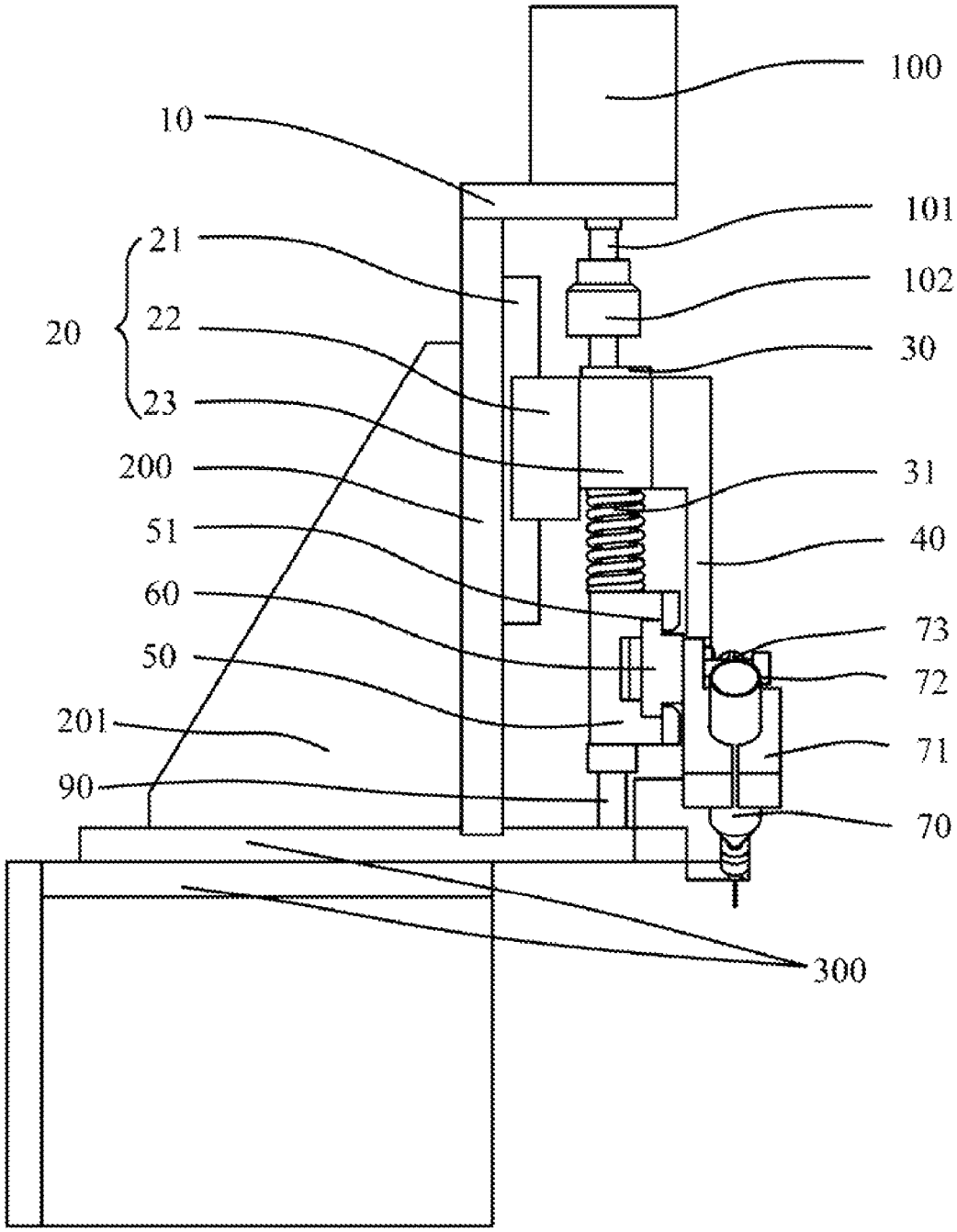
FIG. 3 is a side elevational view of the automatic gluing mechanism shown in FIG. 1.

With reference to the drawings and in particular to FIGS. 1-3, the present invention provides an automatic gluing mechanism, which comprises a vertical board 200, a power cylinder 100, such as a pneumatic cylinder, which is mounted to an end of the vertical board 200 by a power cylinder mounting board 10, and a support rack 300 that is perpendicularly mounted to an opposite end of the vertical board 200. A bracing plate 201 is additionally connected between the vertical board 200 and the support rack 300 for securely supporting the vertical board 200.

The automatic gluing mechanism further comprises a position adjusting member 20, two connection bars 30, a cam 40, a first connection block 50, two slidable members 60, two glue applicator tubes 70, two glue applicator tube holders 71, a resilient element 80, two rollers 73, and a stop block 90. The position adjusting member 20 is mounted to an end of a piston rod 101 of the power cylinder 100 and is slidably coupled to the vertical board 200. The piston rod 101 comprises a flexible coupling 102 fit thereto for absorbing positional and angular errors between the power cylinder 100 and the position adjusting member 20. The position adjusting member 20 receives the two connection bars 30 vertically extending therethrough. The other ends of the two connection bars 30 are coupled to the first connection block 50. The first connection block 50 and the position adjusting member 20 are slidable in a vertical direction along the two connection bars 30.

Referring to FIG. 2, the first connection block 50 forms a sliding channel 51 that extends in a horizontal direction through the first connection block 50. The two slidable members 60 are arranged in the first connection block 50 and are symmetric with respect to a central axis of the first connection block 50. The two slidable members 60 are in mating engagement with the sliding channel 51 and are slidable inside and along the sliding channel 51. The two rollers 73 are respectively mounted to the two slidable members 60. The cam 40 has an end fixed to the position adjusting member 20 and an opposite end forming a camming surface, which is in engagement with inner sides of the two rollers 73. The glue applicator tubes 70 are respectively and rotatably coupled to the two slidable members 60 through the two glue applicator tube holders 71. Further, the resilient element 80 is arranged between the two glue applicator tubes 70. The two glue applicator tube holders 71 are respectively set in engagement with outer sides of the two rollers 73. Further, the stop block 90 is arranged below the first connection block 50. The stop block 90 is fixed to the support rack 300 to stop downward movement of the first connection block 50.

The position adjusting member 20 comprises two rails 21, two slide blocks 22, and a second connection block 23. The second connection block 23 of the position adjusting member 20 is fixedly mounted to the end of the piston rod 101. The two slide blocks 22 are respectively and fixedly mounted to opposite side portions of the second connection block 23. The two the rails 21 are mounted to the vertical board 200. The two slide blocks 22 respectively engage the two rails 21 for sliding with respect to the vertical board 200. The two connection bars 30 vertically extend through the second connection block 23 of the position adjusting member 20.

Preferably, the two glue applicator tube holders 71 are respectively and rotatably mounted to the two slidable members 60 by two pivots 72, and opposite ends of the resilient element 80 are respectively attached to the two pivots 72. Preferably, the resilient element 80 comprises a spring, such as helical spring.

Preferably, the two connection bars 30 comprise two compression springs 31 respectively encompassing the connection bars for cushioning between the first connection block 50 and the first connection block 23.

Reference will be made to FIGS. 1-3 for illustration the operation of the automatic gluing mechanism according to the present invention. To start a gluing cycle, the piston rod 101 first moves downward, driving the position adjusting member 20 that is mounted to the piston rod 101 to move in a vertical direction with respect to the vertical board 200 in order to cause the first connection block 50 that is coupled to the position adjusting member 20 through the two connection bars 30 to also move downward. At this time, no relative movement of the cam 40 with respect to the slidable members 60 occurs so that the end of the cam 40, which forms the camming surface, is located between the two rollers 73 and the resilient element 80 is in a stretched condition. Once the first connection block 50 moves downward to such an extent to engage the stop block 90, the downward movement of the first connection block 50 is stopped, but the position adjusting member 20 is still moving downward as being driven by the piston rod 101, making the cam 40 continuously moving downward. When the end of the cam 40 passes between the two rollers 73, the resilient element 80, which is in a stretched condition, is allowed to shrink toward a central site, causing the two slidable members 60 to simultaneously approach the central site. A such, a horizontal displacement is realized and such a displacement causes the two glue applicator tube holders 71 that are respectively mounted to the two slidable members 60 to simultaneously approach the central site and also bring the two glue applicator tubes 70 carried by the two glue applicator tube holders 71 toward the central site to respectively engage the opposite sides of a work piece to which glue is to be applied and apply glue to the work piece. This completes the gluing cycle.

As mentioned above, the automatic gluing mechanism according to the present invention uses only the vertical movement induced by the power cylinder 100 to control both the vertical movement of the glue applicator tubes 70 in the vertical direction that is for adjustment of the vertical position of the glue applicator tubes 70 and the horizontal movement of the glue applicator tubes 70 in the horizontal direction that is for adjustment of horizontal spacing distance between the two glue applicator tubes 70. This improves the operation efficiency of the automatic gluing mechanism. Further, since the automatic gluing mechanism has a simple construction so that the manufacturing cost of the automatic gluing mechanism can be reduced.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An automatic gluing mechanism, which comprises a vertical board, a support rack perpendicularly mounted to an end of the vertical board, and a power cylinder mounted to an opposite end of the vertical board, the automatic gluing mechanism further comprising:

a position adjusting member, which is slidably coupled to the vertical board, the position adjusting member being operatively coupled to the power cylinder;

a first connection block, which is coupled to the position adjusting member in a relatively slidable manner;

two slidable members, which are slidably mounted to the first connection block;

two glue applicator tubes, which are respectively and rotatably mounted to the two slidable members;

a resilient element, which is resiliently connected between the two glue applicator tubes;

a cam, which has an end mounted to the position adjusting member and an opposite end forming a camming surface, the slidable members engaging the camming surface of the cam to follow the camming surface; and a stop block, which is mounted to the support rack to stop an excessive downward movement of the first connection block.

2. The automatic gluing mechanism as claimed in claim 1, wherein the first connection block forms a horizontally extending sliding channel, the slidable members being slidable along the sliding channel.

3. The automatic gluing mechanism as claimed in claim 2, further comprising two glue applicator tube holders to which the two glue applicator tubes are respectively mounted, the two glue applicator tube holders being respectively and rotatably coupled to the two slidable members by two pivots.

4. The automatic gluing mechanism as claimed in claim 3, further comprising two rollers, which are respectively mounted to the two slidable members, the cam being arranged between the two rollers to engage one side of each of the rollers, each of the glue applicator tube holders being in engagement with another side of each of the rollers.

5. The automatic gluing mechanism as claimed in claim 1, further comprising a connection bar extending through the position adjusting member, the position adjusting member and the first connection block being slidable along the connection bar.

6. The automatic gluing mechanism as claimed in claim 1, wherein the vertical board forms rails and wherein the position adjusting member comprising a second connection block that is coupled to the power cylinder and the cam and slide blocks that are mounted to the second connection block and are slidable along the rails of the vertical board.

7. The automatic gluing mechanism as claimed in claim 5, further comprising a compression spring encompassing the connection bar.

* * * * *